United States Patent [19]

Rosenberg

[11] 4,437,624

[45] Mar. 20, 1984

[54] POSITIONING REEL

[75] Inventor: Irwin Rosenberg, Ann Arbor, Mich.

[73] Assignee: Aero-Motive Mfg. Co., Kalamazoo, Mich.

[21] Appl. No.: 344,637

[22] Filed: Feb. 1, 1982

[51] Int. Cl.[3] ..... B65H 75/48

[52] U.S. Cl. ..... 242/107.3

[58] Field of Search ..... 242/107.3, 107.15, 107.4 R, 242/107.6, 107.7, 99; 248/329, 330.1

[56] References Cited

U.S. PATENT DOCUMENTS

| | | | |
|---|---|---|---|
| Re. 11,067 | 3/1890 | Griswold | 242/107.3 |
| 210,697 | 12/1878 | Lake | 242/107.3 |
| 518,967 | 5/1894 | Poole | 242/107.3 |
| 670,949 | 4/1901 | Carpenter | 242/107.11 |
| 2,633,609 | 3/1953 | Kirby | 242/107.6 |
| 2,637,109 | 5/1953 | Willis | 242/107.11 X |
| 2,756,945 | 7/1956 | Robboy | 242/107.15 |
| 2,794,607 | 6/1957 | Robboy | 242/107.3 |
| 3,041,044 | 6/1962 | Nixon | 242/107.3 X |
| 3,316,361 | 4/1967 | Thompson | 242/107.3 X |
| 3,637,159 | 1/1972 | Caramella | 242/107.3 |
| 4,103,844 | 8/1978 | Deinert et al. | 242/107 |
| 4,106,719 | 8/1978 | Haverland | 242/96 |
| 4,113,200 | 9/1978 | Tanaka | 242/107 |
| 4,205,807 | 6/1980 | Shimogawa et al. | 242/107 |
| 4,213,580 | 7/1980 | Kawaharazaki | 242/107 |
| 4,300,732 | 11/1981 | Gaeta | 242/107.3 |

*Primary Examiner*—John M. Jillions

*Attorney, Agent, or Firm*—Emrich, Lee, Brown & Hill

[57] ABSTRACT

A positioning reel for suspending a body, such as a lightweight tool, at any vertical position within the limits of the suspension cord length is disclosed. An adjusting screw which regulates a clutch-type tensioning brake permits the supporting force of the positioning reel to be set to equalize the weight of the suspended body such that little effort is required to lower the suspended body. With the downward external positioning force removed from the suspended body, it remains in its present position. The suspended body can be easily raised by applying an upward external force equal to slightly more than the weight of the suspended body. When raising the suspended body, a clock-type coil spring actuates a spool within the positioning reel for retracting the suspension cord. A spring-type override clutch permits reeling in the suspension cord while bypassing the tensioning brake. With the upward external force removed from the suspended body, it will again remain in its present position.

11 Claims, 6 Drawing Figures

FIG. 4
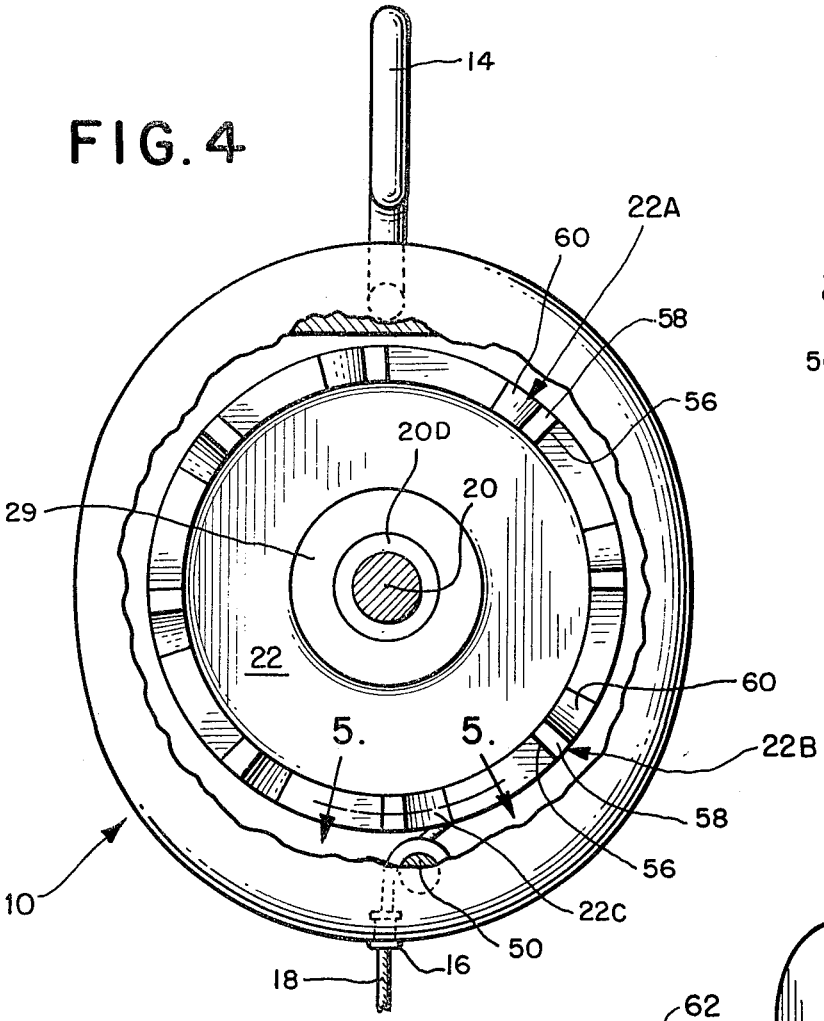
FIG. 5
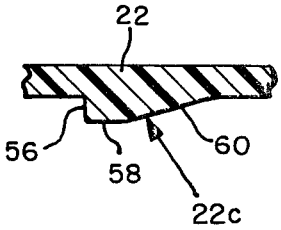
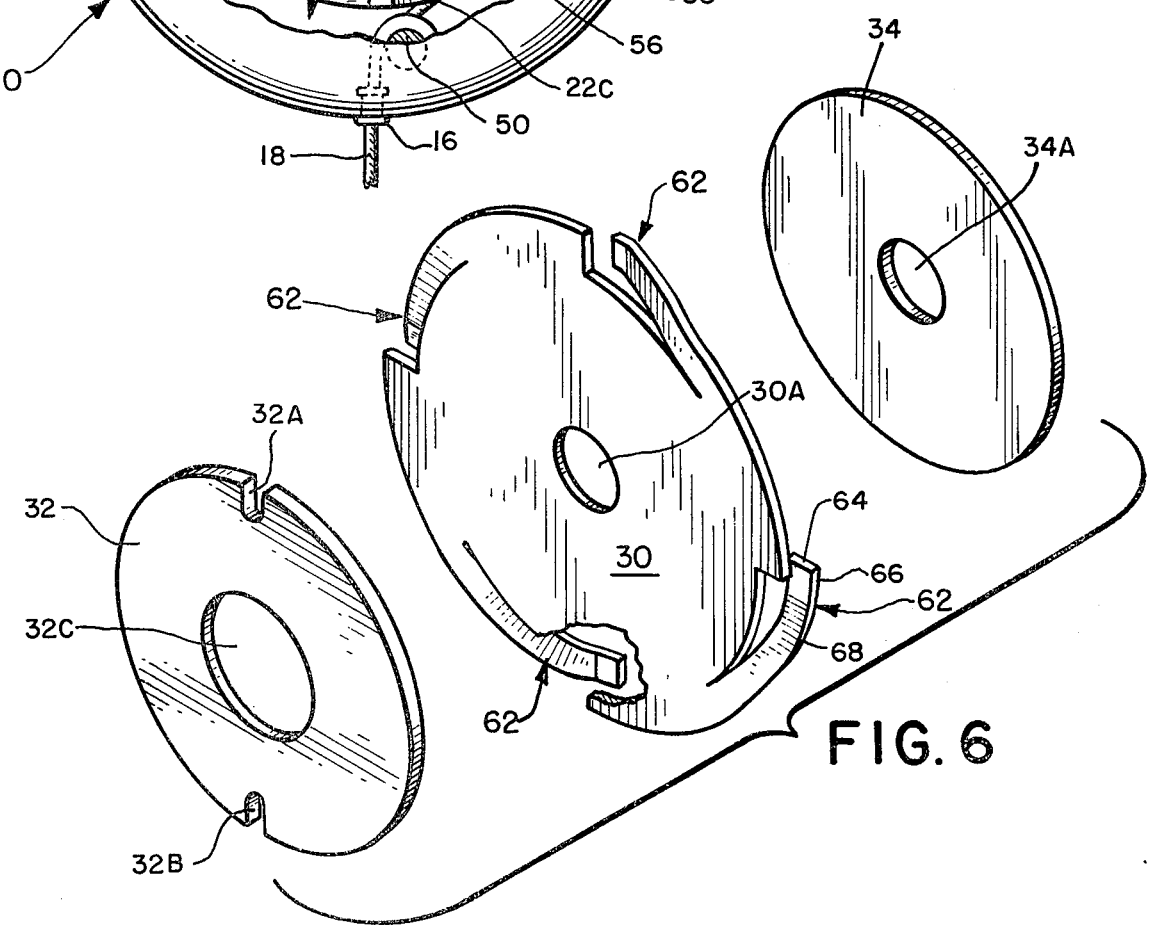
FIG. 6

POSITIONING REEL

BACKGROUND OF THE INVENTION

This invention generally relates to a system for selectively positioning a suspended body and more specifically is directed to a positioning reel for suspending a body by means of a suspension cord in an easily movable, yet stable position.

Variable positioning/suspension devices are well known in the art. Such devices are commonly used to support such items as overhead light fixtures, plants and hand tools for use on an assembly line. The suspended body is connected to a cable which is generally wound on a drum or reel and counterbalanced by means of a spring biasing the reel or a weight. The reel mechanism is typically enclosed in an oval or spherical shaped housing which is suspended from an overhead support. The rotation of the reel or drum is generally resisted by means of one or more brake shoes. In some such devices, the combination of a ratchet wheel and pawl is utilized to permit free displacement of the suspension cord in one direction, such as upward, while restraining the downward displacement of the suspended body.

The devices generally described in the preceding paragraph have suffered from various limitations. For example, in the past the typical support or positioning device was overly complex and included a large number of components. This not only reduced the reliability and hence the operating lifetime of such devices, but also generally increased their size and weight. The increased complexity and larger number of components, of course, results in an increase in the unit cost of such devices. In addition, prior art devices have been designed generally to operate in supporting only a predetermined weight such that a change in the value of this weight results in a non-equilibrium situation in which stable positioning of the new weight is either not available or can be accomplished only by complicated adjustments or changing components. Finally, provision for upraising the suspended body by merely lifting the object without resort to another control or a special latch releasing procedure is generally available only in the larger, more complex and expensive prior art devices.

The present invention does not suffer from these limitations in that it is not overly complex in design and uses a minimum number of components, may be utilized in supporting virtually any weight by means of a simple, external adjustment, and permits the free upward displacement of the suspended object by merely lifting it. In addition, the present invention is compact and rugged and, because it is completely enclosed in a hard plastic housing, is not subject to contamination.

SUMMARY OF THE INVENTION

The present invention includes a plastic spool rotationally biased by a coil spring which is fixedly coupled to a non-rotating steel shaft positioned within and along the rotational axis of the spool. A cord which may be attached to a body to be suspended is wrapped around the spool. A first lateral surface of the spool includes tooth-shaped projections thereon which are engageable by complementary peripheral projections on a ratchet spring positioned in facing relation to and in contact with the first lateral surface of the spool. A center portion of the disk-shaped ratchet spring is positioned between an outer non-rotating brake pad and an inner back plate which is immediately adjacent the first lateral surface of the spool. A selectively adjustable screw coupled to an end portion of the steel shaft permits it to be displaced along the spool's axis of rotation and to contact and displace the back plate toward the ratchet spring so as to increase the pressure between the ratchet spring and the brake pad thus inhibiting rotation of the ratchet spring. By selectively varying this pressure, the weight of a body supported by the suspension cord may be mechanically balanced such that little effort is required to lower the position of the suspended body regardless of its weight. With the vertical forces thus in equilibrium, when the downward force is removed from the suspended body, it will remain stably positioned. The suspended body can be raised by applying an upward external force equal to slightly more than the weight of the suspended body with the coil spring energized spool retracting the suspension cord in response thereto.

A curved spring washer is positioned between the adjusting screw and the ratchet side of the housing of the positioning reel to enhance pressure adjustment sensitivity. As the suspended body is lowered, the tooth-shaped projections on the spool engage the ratchet spring projections causing the rotation thereof in overcoming the friction between the ratchet spring and the brake pad. When the suspended body is raised, the coil spring rotates the spool in the opposite direction retracting the suspension cord. When retracting the suspension cord, the tooth-shaped projections on the spool deflect the cantilevered projections on the ratchet spring allowing the spool to rotate without rotating the ratchet spring. The aforementioned components of the positioning reel are compactly configured and enclosed in a hard plastic housing which includes an aperture for free suspension cord movement therethrough, a ring for suspending the positioning reel itself and the easily accessible adjusting screw positioned on a lateral surface of the housing. In addition, the inner walls of the housing form integrating parts of the positioning wheel while providing effective seatings for the various components thereof.

BRIEF DESCRIPTION OF THE DRAWINGS

The appended claims set forth those novel features believed characteristic of the invention. However, the invention itself, as well as further objects and advantages thereof will best be understood by reference to the following detailed description of a preferred embodiment taken in conjunction with the accompanying drawings, where like reference characters identify like elements throughout the various figures, in which:

FIG. 4 is a partially broken away side elevation view of the positioning reel taken along the line and in the direction of the arrows 4—4 of FIG. 3;

FIG. 5 is a horizontal elevation view of a portion of a lateral surface of the spool of the positioning reel showing the configuration of the engaging projections thereon taken along the line and in the direction of the arrows 5—5 of FIG. 4; and FIG. 6 is an exploded, perspective view of the brake pad, ratchet spring and back plate combination utilized in the positioning reel of the present invention.

DETAILED DESCRIPTION OF THE PREFERRED EMBODIMENT

Figure 1:
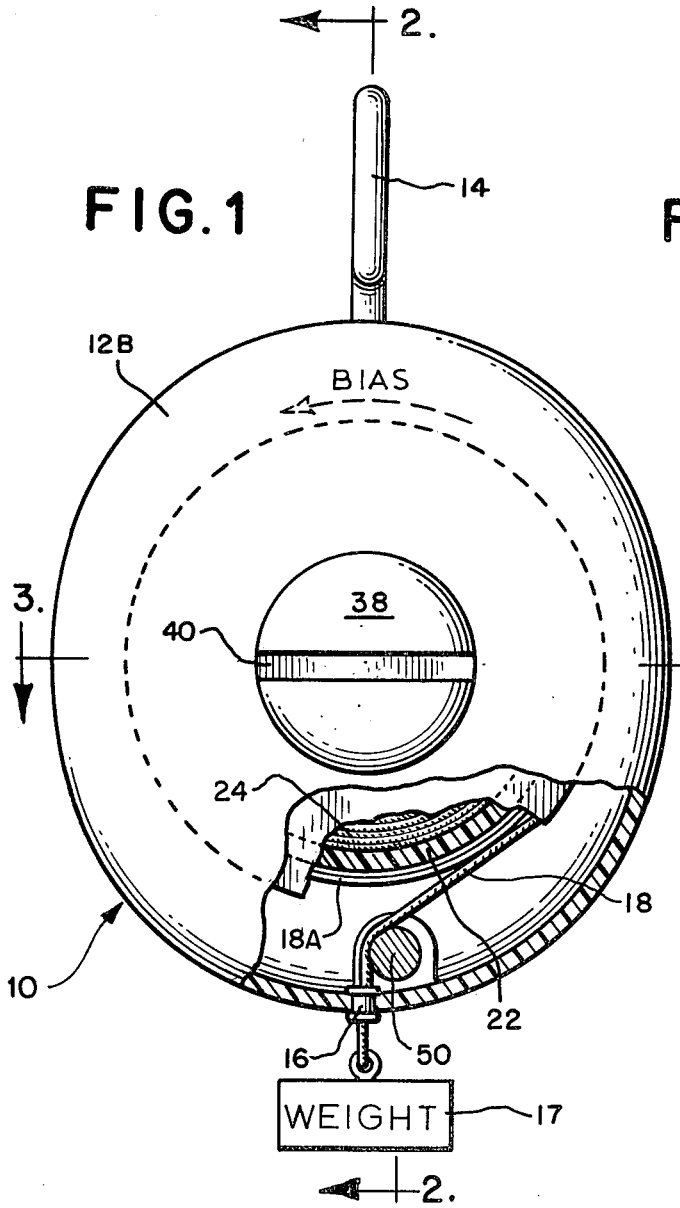
FIG. 1 is a partially broken away side elevation view of a positioning reel in accordance with the present invention taken along the line and in the direction of the arrows 1—1 of FIG. 2.
Figure 2:
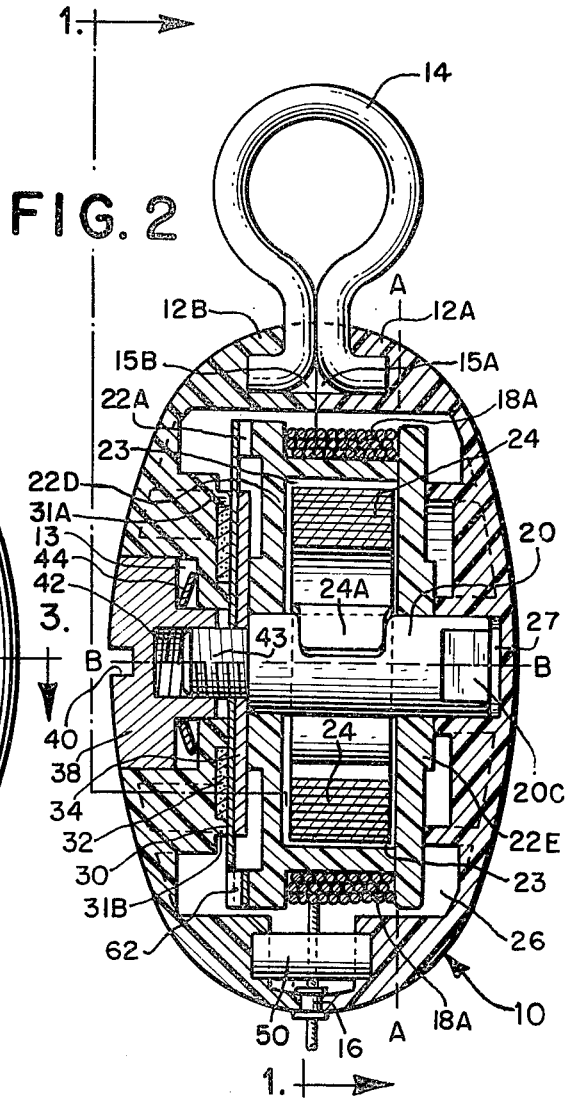
FIG. 2 is a vertical sectional view of the positioning reel shown in FIG. 1 taken along the line and in the direction of the arrows 2—2 of FIG. 1.
Figure 3:
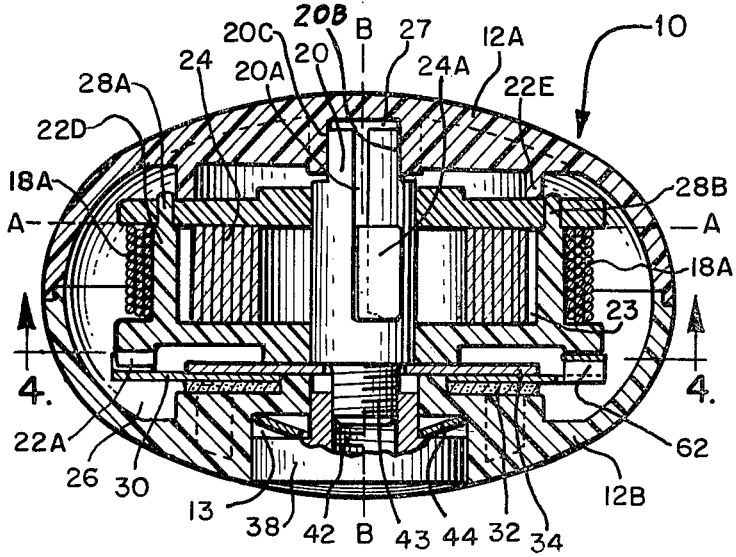
FIG. 3 is a horizontal sectional view of the positioning reel taken along the line and in the direction of the arrows 3—3 of FIG. 1.

Referring to FIG. 1 which is a partially broken away side view, FIG. 2 which is a vertical sectional view, and FIG. 3 which is a horizontal sectional view, there is shown a positioning reel in accordance with the preferred embodiment of the present invention. The positioning reel 10 includes an outer structure comprised of right and left complementary housings 12A, 12B. Right and left housings 12A, 12B, which are preferably comprised of a high strength plastic, are joined and securely coupled together by means of sonic welding in a preferred embodiment although any conventional coupling method could as easily be utilized. During the assembly of right and left housings 12A, 12B, a suspension ring 14 is inserted in respective slots 15A, 15B of the right and left housings. Suspension ring 14 is thus structurally integrated with the right and left housings 12A, 12B permitting the positioning reel to be coupled to a support member (not shown) located above the positioning reel. Similarly, a roller 50 is inserted in respective, adjacent slots in the lower portion of right and left housings 12A, 12B during the assembly of positioning reel 10. Roller 50 is preferably comprised of a rigid material and performs the function of guiding the suspension cord 18 in a manner to be presently described. Finally, eyelet 16 is inserted in complementary, adjacent openings in the lower portions of right and left housings 12A, 12B during their assembly in forming positioning reel 10. Eyelet 16 thus provides an aperture in the housing of positioning reel 10 through which suspension cord 18 may be easily displaced.

Once assembled along their respective edge portions, right and left housings 12A, 12B define a housing chamber 26 into which various other components of positioning reel 10 are positioned prior to the assembly of the right and left housings. Included within the assembled right and left housings 12A, 12B is a spool 22 which includes a main portion 22D and a lateral portion 22E. Spool 22 is also preferably fabricated from a high strength plastic with the main and lateral portions 22D, 22E thereof sonic welded together along line A—A. Main spool portion 22D including a plurality of projections 28A, 28B which are keyed to complementary apertures in lateral spool section 22E by means of which the two sections may be fitted together prior to being permanently joined together as shown in FIG. 3.

The main and lateral portions 22D, 22E of the spool each include an aperture located in the center of a lateral surface of each component. Through these apertures is inserted a shaft 20 which includes a slot 20A extending from one end thereof toward its center portion. Prior to the assembly of the main and lateral portions 22D, 22E of spool 22, a coil spring 24 is inserted in a spool cavity 23 formed by the assembly of the main and lateral spool sections 22D, 22E. The outer portion of coil spring 24 is coupled to the inner, circular surface of the main portion 22D of the spool in a conventional manner. The coil spring 24 includes an inner coil 24A which is coupled to shaft 20 by inserting it into the end slot 20A of shaft 20. Thus, with the assembled spool 22 rotationally positioned on shaft 20, coil spring 24 biases spool 20 in a counterclockwise direction as shown in FIG. 1.

Adjacent slot 20A is an end portion of shaft 20 are located engaging surfaces 20B, 20C. These engaging surfaces on an end portion of shaft 20 are generally parallel to one another and are inserted in a cavity 27 in the right housing 12A of the positioning reel. The lateral surfaces of cavity 27 are keyed to the engaging surfaces 20B, 20C on the end of shaft 20 to preclude the rotation of the shaft once inserted in cavity 27. While the diametrically opposed engaging surfaces 20B, 20C on the end of shaft 20 prevent its rotation once inserted in cavity 27, shaft 20, which preferably is steel, is free to move linearly along its lengthwise axis within cavity 27. By thus inserting shaft 20 in cavity 27 in a tight fitting relation, shaft 20 is nonrotationally positioned within positioning reel 10.

The outer, lateral surface of the main portion 22D of spool 22 includes a plurality of projections 22A around the periphery thereof. These projections are generally of a sawtooth shape extending outward from the lateral surface of spool 22. A plurality of such projections are equally spaced around the periphery of spool 22 on its lateral surface, although in the sectional views of FIGS. 2 and 3 only one projection 22A is shown on the lateral surface of spool 22. These projections, which are described in detail below with respect to FIGS. 4 and 5, are positioned in facing relation to a ratchet spring 30 which is positioned between and in contact with a back plate 34 and a brake pad 32. Ratchet spring 30, brake pad 32 and back plate 34 each include an aperture in the center thereof for the positioning of shaft 20 therethrough. Back plate 34 is positioned between ratchet spring 30 and spool 22, while brake pad 32 is positioned between ratchet spring 30 and left housing 12B.

The inner surface of ratchet spring 30 includes a plurality of projections 62 around the periphery thereof, although only a single projection is shown in the sectional views of FIGS. 2 and 3. Each projection 62 is in facing relation and immediately adjacent to the lateral surface of spool 22 on which the complementary, sawtooth shaped projections 22A are positioned. The configuration and orientation of the projections on the inner surface of ratchet spring 30 and their engagement with the lateral surface of spool 22 is described below with respect to FIGS. 4, 5 and 6.

Ratchet spring 30, brake pad 32 and back plate 34 are symmetrically positioned along the axis B—B of shaft 20. Brake pad 32 is in contact with an outer surface of ratchet spring 30 while back plate 34 is positioned in contact with an inner surface of ratchet spring 30. Referring to FIG. 6, brake pad 32 includes keying apertures 32A, 32B displaced 180° with respect to one another on the periphery of brake pad 32. An interior portion of left housing 12B includes keying inserts 31A, 31B which are keyed to and inserted in brake pad 32 when it is properly inserted in left housing 12B. These keying inserts and complementary apertures in brake pad 32 prevent its rotation and provide for a stable positioning of brake pad 32 in the interior of the positioning reel.

Left housing 12B includes an aperture 13 in which is inserted an adjusting screw 38. Adjusting screw 38 includes a slit 40 on an outer surface thereof for the insertion of a screwdriver, or similar engaging instruction, which permits adjusting screw 38 to be rotated with respect to the axis defined by shaft 20. The end of shaft 20 immediately adjacent to the adjusting screw 38 includes a threaded portion 43 by means of which shaft 20 may be coupled to an inner portion of the adjusting screw 38 which is provided with a complementary threaded portion 42. While shaft 20 is not free to rotate within cavity 27, shaft 20 is sized so as to be linearly displaceable along its axis indicated as B—B within cavity 27. Thus, by rotating adjusting screw 38, shaft 20 may be linearly displaced along axis B—B within cavity 27 as desired. By rotating adjusting screw 38 in one direction, shaft 20 may be displaced in a leftward direction as shown in FIG. 2 so as to be drawn up against back plate 34 which, in turn, displaces back plate 34 and ratchet spring 30 so as to increase the pressure between ratchet spring 30 and brake pad 32. Rotation of adjusting screw 38 in this manner thus tends to inhibit the rotation of ratchet spring 30. Due to the interlocking projections on immediately adjacent facing surfaces of ratchet spring 30 and spool 22, the rotation of spool 22 in one direction may be precisely controlled. By thus selectively positioning adjusting screw 38, the pressure between nonrotating brake pad 32 and ratchet spring 30 may be adjusted to balance a suspended weight 17 attached to a suspension cord 18 which includes a portion 18A wound tightly around spool 22. Thus, the positioning reel of the present invention may be precisely and easily controlled by means of a single adjustment for stably positioning a body of virtually any desired weight.

A curved spring washer 44 is inserted between adjusting screw 38 and a recessed portion of left housing 12B in order to provide a resistance against the tightening of adjusting screw 38 so as to enhance the sensitivity of the weight adjustment of positioning reel 10. A roller 50 located in a lower portion of positioning reel 10 is inserted in immediately adjacent apertures on the inner portions of right and left housings 12A, 12B and is maintained stably therein. Roller 50 provides a low friction, wear resistant deflection point for the vertical displacement of suspension cord 18 which is affixed to and wound around spool 22. Suspension cord 18 is directed through an eyelet 16 positioned in a aperture on a lower portion of the surface of positioning reel 10 so as to minimize wear on the plastic housing of the positioning reel due to the vertical displacement of suspension cord 18 to which weight 17 is attached.

Referring to FIGS. 4, 5 and 6, the configuration and operation of the clutch-tensioning brake which permits the supporting force of the positioning reel 10 to be set to equalize the weight of the suspended body, and the spring-type override clutch providing for the uptake of the suspension cord by merely lifting the suspended body will now be described in detail. As previously stated, a plurality of sawtooth-shaped projections are positioned around the periphery of a lateral surface of spool 22 as shown in FIG. 4. Three of these projections are indicated as elements 22A, 22B and 22C although it can be seen from the figure that additional projections are symmetrically positioned around the periphery of the facing lateral surface of spool 22. Referring to FIGS. 4 and 5, it can be seen that each projection on the lateral surface of spool 22 includes a front surface 56, an upper surface 58 and an inclined surface 60. With reference to FIG. 4, it can be seen that the clockwise rotation of spool 22 will cause the front surface 56 of each of the projections to face the direction of rotation, while the counterclockwise rotation of spool 22 will cause the inclined surface 60 of each projection to face the direction of spool rotation.

FIG. 6 is an exploded view of brake pad 32, ratchet spring 30 and back plate 34 showing their relative positions with shaft 20 inserted in the respective apertures 32C, 30A and 34A, respectively. Ratchet spring 30 includes a plurality of cantilevered projections 62 around the periphery thereof which are positioned in facing relation to the peripheral projections on the lateral surface of spool 22. Each cantilevered projection 62 on the periphery of ratchet spring includes an engaging front surface 64, an upper surface 66 and an inclined surface 68. As the suspended body is lowered, the sawtooth-shaped projections 22A, 22B and 22C located around the periphery of the lateral surface of spool 22 engage a corresponding cantilevered projection 62 causing the rotation of the ratchet spring 30 in a first direction (which in FIG. 4 would be clockwise) by overcoming the friction between the ratchet spring 30 and the brake pad 32. Since the friction between the ratchet spring and the brake pad may be selectively adjusted by setting the pressure between these components as desired by means of adjusting screw 38, positioning reel 10 may be precisely adjusted to accommodate the support of a body of virtually any weight. When the suspended body is raised by applying an upward external force equal to slightly more than the weight of the suspended body, the biasing coil spring 24 rotates the spool in a second, opposite direction (which in FIG. 4 is counterclockwise) in retracting the suspension cord 18. During suspension cord retraction the sawtooth-shaped projections on the lateral surface of spool 22 deflect the cantilevered projections 62 on the periphery of the facing surface of ratchet spring 30 allowing the spool to rotate while the ratchet spring remains fixed. The deflection of the cantilevered projections on ratchet spring 30 occurs when the inclined surfaces 60 of the sawtooth-shaped projections on spool 22 engage and deflect the inclined surfaces 68 of each of the cantilevered projections 62 of ratchet spring 30. The projections on the lateral surface of spool 22 and the cantilevered projections on the inner surface of ratchet spring 30 thus act as a spring-type overrunning clutch when spool 22 is rotated in the second direction of rotation which facilitates reeling in the suspension cord 18 and the supported body (not shown) coupled thereto while bypassing the tensioning brake which includes ratchet spring 30, brake pad 32, back plate 34 and the variably positioned shaft 20.

When the upward force is removed from the suspended body, it will again remain in a fixed vertical position due to the pressure between brake pad 32 and ratchet spring 30 which engages spool 22 by means of the respective projections around the periphery of the facing surfaces thereof so as to prohibit the rotation of spool 22 in the aforementioned first direction of rotation.

The cantilevered engaging projections 62 of ratchet spring 30 are formed by cutting the ratchet spring in a plurality of locations around the periphery thereof so as to form a number of easily shaped structures still firmly coupled to the ratchet spring. Each of these cantilevered sections is then formed into a structure slightly upraised from the surface of the ratchet spring in forming a plurality of projections thereon. As described herein, spool 22 and ratchet spring 30 include a plurality of equally spaced, engaging projections on facing surfaces thereof. However, the principle of the present invention encompasses the use of a single engaging projection on each of the facing surfaces of spool 22 and ratchet spring 30. The use of a plurality of such projections on these facing surfaces increases the support strength of the positioning reel while providing a near continuum of vertical positions available in locating the suspended body.

There has thus been described a positioning reel for supporting a body therefrom which may be easily adjusted to accommodate virtually any supported weight while permitting the supported body to be easily raised and lowered and to stably maintain its last adjusted position. In addition, the supported body may be located over a virtual continuum of positions extending the entire length of the suspension cord.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. A suspension positioning apparatus comprising: a housing; a non-rotating shaft variably positioned along the axis thereof within said housing; a spool rotationally mounted on said shaft and adapted to receive a suspension cord therein, said spool including at least one first engagable projection on a lateral surface thereof; first biasing means coupled to said spool for rotationally urging said spool in a first direction of rotation about said shaft, said first direction of rotation representing the direction of suspension cord take-up; a first disk rotationally positioned along said shaft and including a first surface in facing relation and in contact with the lateral surface of said spool, wherein said first surface includes at least one second engagable projection thereon for engaging said first projection when said spool rotates in a second direction representing the direction of suspension cord pay-out, and wherein said first disk is movable along the axis of said shaft in response to the displacement of said shaft; a second disk fixedly positioned in said housing along said shaft and adapted to contact and frictionally engage a second surface of said first disk in inhibiting the rotation thereof; and adjustable control means positioned on a side of said housing and coupled to said shaft for displacing said shaft along its axis in positioning said first disk in selective engagement with said second fixed disk for controlling the rotation of said spool in said second direction of rotation when said first and second projections are engaged.

2. The apparatus of claim 1 further comprising second biasing means coupled to said adjustable control means for opposing changes in said adjustable control means in enhancing the sensitivity of adjustments thereto.

3. The apparatus of claim 2 wherein said second biasing means includes a curved spring washer positioned in contact with said adjustable control means in opposing any changes therein.

4. The apparatus of claim 1 wherein said first biasing means includes a coil spring having an inner coil fixedly coupled to said shaft.

5. The apparatus of claim 1 wherein said at least one first engagable projection is positioned adjacent the periphery of said spool and said at least one second engagable projection is positioned adjacent the periphery of said first disk.

6. The apparatus of claim 5 further including spacer means positioned immediately adjacent said first disk and adapted to engage said shaft when said shaft is displaced along its axis by said adjustable control means so as to selectively engage and urge said first disk against said second disk in response to the setting of said adjustable control means.

7. The apparatus of claim 1 wherein said housing includes attachment means securely coupled to an upper portion thereof for suspending said positioning apparatus from a support member.

8. The apparatus of claim 1 wherein said housing includes an aperture in a lower portion thereof for permitting the vertical displacement of said suspension cord therethrough.

9. The apparatus of claim 1 wherein the interior of said housing is adapted to securely engage said shaft and said second disk in preventing the rotation thereof in said housing.

10. The apparatus of claim 1 wherein said adjustable control means includes an adjusting screw threadably coupled to said shaft wherein the rotation of said adjusting screw causes said shaft to be linearly displaced along its axis.

11. The apparatus of claim 1 wherein said first and second engagable projections form a ratchet configuration allowing free rotation between said spool and said first disk in said first direction of rotation and controlling rotation between said spool and said first disk in said second direction of rotation.

* * * * *